United States Patent [19]

Kato et al.

[11] 4,145,210

[45] Mar. 20, 1979

[54] PROCESS FOR INDURATING DRIED PELLETS IN A ROTARY KILN

[75] Inventors: Kazumasa Kato, Wakayama; Kenji Kadota, Niihama, both of Japan

[73] Assignees: Sumitomo Metal Industries, Ltd., Osaka; Sumitomo Heavy Industries, Ltd., Tokyo, both of Japan

[21] Appl. No.: 770,947

[22] Filed: Feb. 22, 1977

[30] Foreign Application Priority Data

Feb. 24, 1976 [JP] Japan ..... 51-19754

[51] Int. Cl.[2] ..... C22B 1/14

[52] U.S. Cl. ..... 75/3; 266/99

[58] Field of Search ..... 75/3, 4, 5, 33, 34, 75/35, 36, 29; 266/99

[56] References Cited

U.S. PATENT DOCUMENTS 1,786,999 12/1930 Hornsey ..... 75/36

3,918,958 11/1975 Heitmann ..... 75/36

FOREIGN PATENT DOCUMENTS 1264452 2/1972 United Kingdom ..... 75/33

*Primary Examiner*—L. Dewayne Rutledge
*Assistant Examiner*—Michael L. Lewis
*Attorney, Agent, or Firm*—Flynn & Frishauf

[57] ABSTRACT

Process for indurating dried pellets in a rotary kiln, characterized by charging the dried pellets and coke in the range of from about 2% by weight to about 20% by weight on the weight of the pellets into the rotary kiln, the coke having a size of from about 5 millimeters to about 30 millimeters, drum index ($DI_5^{80}$) of more than 70, reactivity index (AG) of less than 50 and tumbler index ($TI_{50}^{400}$) of more than 50 measured on the basis of Japanese Industrial Standard K2151, and heating the pellets in the kiln is disclosed.

3 Claims, 12 Drawing Figures

FIG. 3
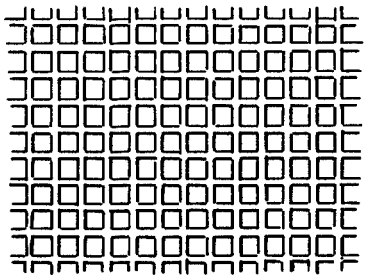
FIG. 4
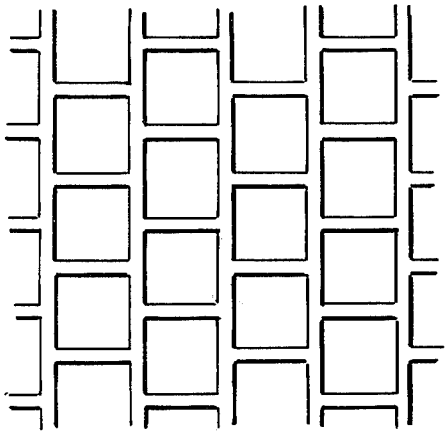
FIG. 5A
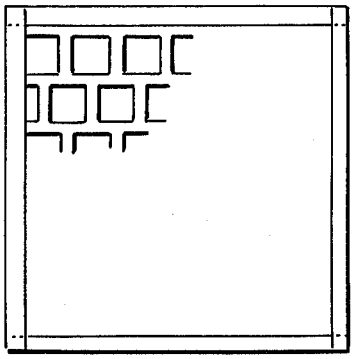
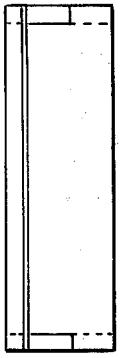
FIG. 5B
FIG. 7A
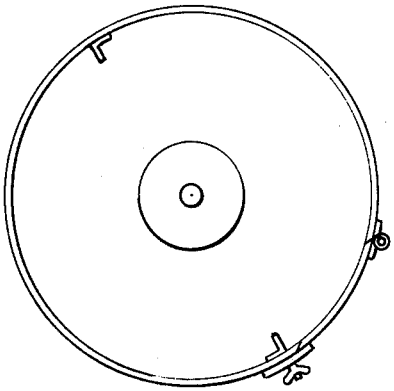
FIG. 7B
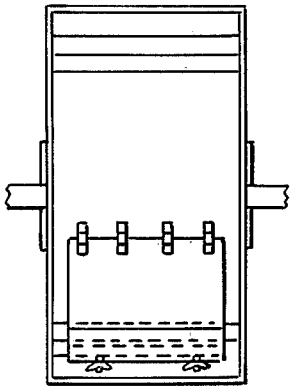

PROCESS FOR INDURATING DRIED PELLETS IN A ROTARY KILN

BACKGROUND OF THE INVENTION

This invention relates to a process for indurating dried pellets with the particulated coke, thereby preparing metallic iron-containing pellets suitable for use as a blast furnace charge. More particularly, this invention relates to a process for producing chemically reduced pellets having high quality while maintaining continuous, stable operation. According to the present invention, even if the pellets are pulverized in the kiln, a ring is not formed during operation in the kiln.

The term "green pellets" in the specification means pellets obtained by pelletizing the iron works dust and/or sludge generated from a blast furnace, electric furnace, converter furnace and/or open hearth furnace, etc. or a mixture of these dusts and optionally carbonecous material, such as coal or coke. The dried pellets are prepared by drying or preheating the green pellets. The term "metallized pellets" in the specification means pellets with a high content of metallic iron obtained by chemically reducing said dried pellets.

It has been known that pellets having a high metallic iron content can be prepared by chemically reducing the dried pellets in a rotary kiln. One process for reducing dried pellets in a rotary kiln comprises the step of charging the pellets into the kiln, and the step of chemically reducing metal oxides contained in the dried pellets at a high temperature and simultaneously volatilizing other metals, particularly zinc. The chemical reduction of the metal oxides with carbon is represented by the following equation:

$$MO + C \rightarrow M + CO$$

wherein M is a metal element. Usually, when dried pellets are indurated in a rotary kiln, some of the pellets are reduced to powder, because of abrasion of the pellets through rolling of the pellets in a low temperature zone of the kiln and degradation of the pellets through formation of wustite at a temperature in the range of 800° to 900° C. The powder so formed deposits on the inside wall of the kiln or on the surface of the remaining pellets, and as a result, a ring is formed in the kiln. When such a ring is formed in the kiln, the temperature distribution and moving of the pellets in the kiln become abnormal; such abnormal temperature distribution and moving impairs the quality of pellets and also makes the operation of the kiln unstable. In addition, such rings shorten the life of the kiln.

BRIEF DESCRIPTION OF THE DRAWINGS

FIG. 3 is a top view of a screen for measuring particle size of coke;

FIG. 4 is an enlarged partial top view of the screen of FIG. 5;

FIG. 5-A is a partial top view of another screen for measuring particle size of coke; FIG. 5-B is a side view of the screen of FIG. 5-A;

FIGS. 6-C and 6-D are respective corresponding views of another drum tester;

FIGS. 7-A and 7-B are end and side views, respectively, of a tumbler for testing coke.

SUMMARY OF THE INVENTION

Figure 1:
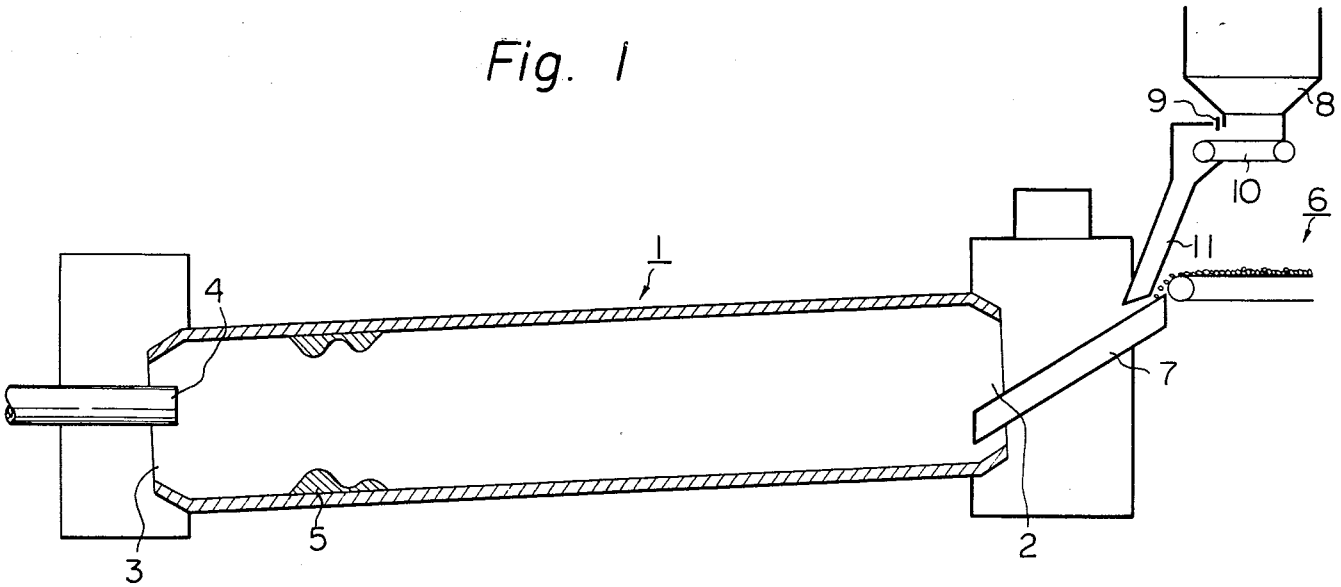
FIG. 1 is an elevational view, partially cut-away, illustrating a conventional kiln structure.

We have carried out research for eliminating these disadvantages of the prior art processes for chemical reduction of dried pellets. We have found that these disadvantages can be overcome by using particulate coke for chemically reducing the dried pellets.

Therefore, an object of this invention is to provide a process for indurating dried pellets without giving rise to the problems mentioned above.

DETAILED DESCRIPTION OF THE INVENTION

This invention relates to a process for indurating dried pellets in a rotary kiln, characterized by charging dried pellets and coke in the range of from about 2% by weight to about 20% by weight on the weight of the pellets into the rotary kiln, the coke having a particle size of from about 5 millimeters to about 30 millimeters, a drum index ($DI_5^{80}$) of more than 70, reactivity index (AG) of less than 50 and tumbler index ($TI_{50}^{400}$) of more than 50 measured on the basis of Japanese Industrial Standard K2151, and heating the pellets in the kiln.

The present process is further explained according to the appended drawings. A rotary kiln is shown at 1. Dried pellets are charged into the rotary kiln 1 from inlet 2 for pellets, and move through the inside of the kiln 1 while rolling and are withdrawn from outlet 3. While the pellets pass through the kiln, they are chemically reduced by heating them by burner 4. Means for supplying the carbon-containing dried pellets into kiln 1 is shown at 6. A chute for charging pellets and coke into kiln 1 is shown at 7. Coke is supplied to chute 7 via hopper for storage 8, cutting gate 9, belt conveyer 10 and coke-charging chute 11. The coke employed in the present invention has a size of from about 5 millimeters to about 30 millimeters, drum index (DIhd $5^{80}$) of more than 70, reactivity index (AG) of less than 50 and tumbler index ($TI_{50}^{400}$) of more than 50 measured on the basis of Japanese Industrial Standard K2151. It is critical that the amount of coke employed be in the range of from about 2 to about 20% by weight on the basis of the weight of dried pellets. In general, coke in the amount of as high as 20% by weight may be charged into the kiln some time after the operation of the kiln has started, since a considerable amount of the pellet powder is present in the kiln. The amount of coke charged is gradually reduced as the operation is continued. The amount of coke charged may be generally as low as 2% by weight in the stable state. The reason why the amount of coke charged is limited to from about 2 to about 20% is as follows:

When coke in the amount of less than 2% by weight is charged into the kiln, the formation of a ring cannot be completely prevented. When coke in the amount of more than 20% by weight is charged into the kiln, the coke not coated with pellet powder is withdrawn from the outlet.

Figure 2:
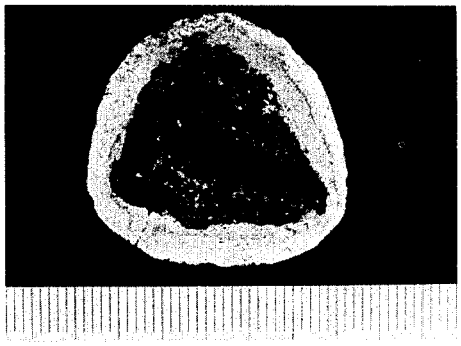
FIG. 2 is a sectional photograph of coke, the surface of which is covered with pellet powder.
Figure 6B:
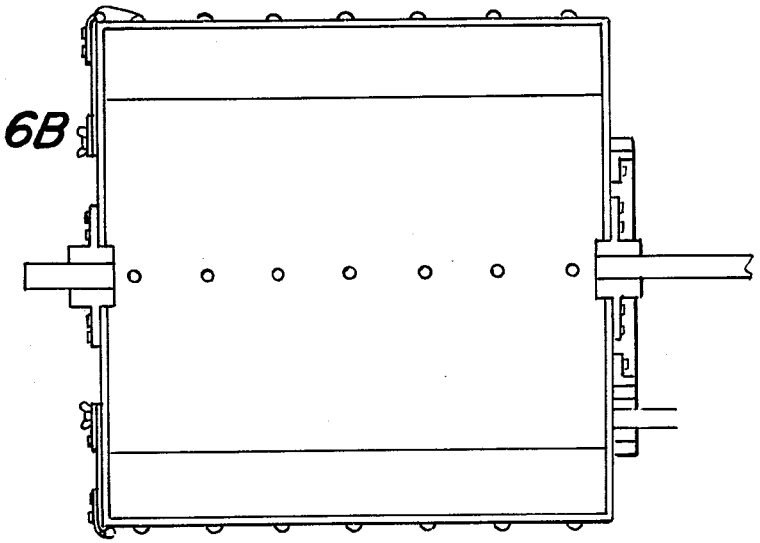
FIGS. 6-A and 6-B are end and side views, respectively, of a drum tester for coke.
Figure 6D:
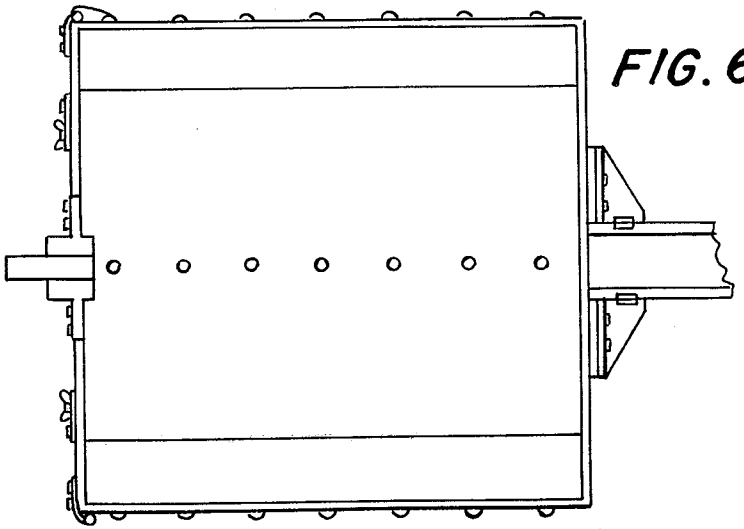
Figure 6A:
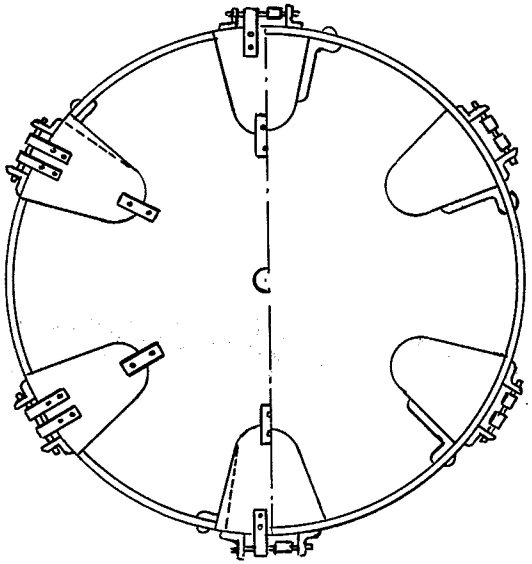
Figure 6C:
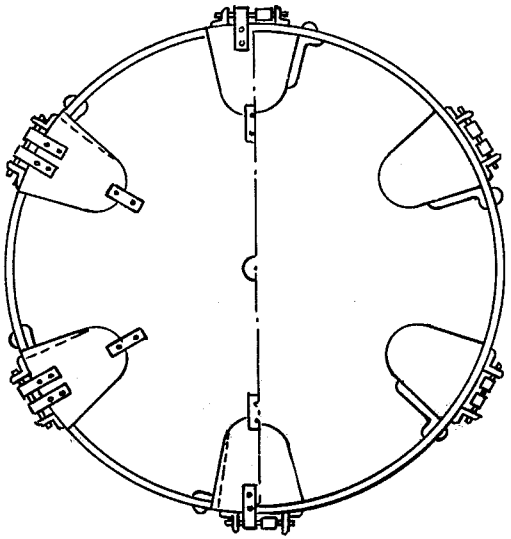

As mentioned above, when dried pellets are chemically reduced in a rotary kiln at a conventional process, some of the pellets are reduced to powder and become free-flowing, because of abrasion of the pellets while rolling through the low temperature zone of the kiln and deterioration of the pellets caused by formation of wustite at a temperature in the range of 800° to 900° C. However, when the particulated coke specified in this invention is charged into the kiln together with the dried pellets, the coke picks up such pellet powder during passage through the kiln from the low temperature zone to the high temperature zone, and the size of the coke particles increases. In other words, the dried pellets are not powderized because of the use of coke having high drum index high abrasion resistance and low reactivity. In addition, Puldow reaction hardly occurs, because of the coke's low reactivity. The term "pellet powder" means powder which is formed when the dried pellet is disintegrated. Since the entire surface of the coke particles becomes coated with the pellet powder during passage of the coke through the low temperature zone, the powder-coated coke is not burned in the kiln. Therefore, the coating of pellet powder on the coke builds up to a thickness of 5 to 10 mm, and coke of the same size as that of the dried pellets originally charged is withdrawn from outlet 3. FIG. 2 is a sectional photograph of the withdrawn coke. FIG. 2 shows the thick coating of white pellet powder on the surface of the coke.

In other words, the particulated coke picks the pellet powder having free flowing property which would otherwise stay in the kiln, and thus formation of a ring of pellet powder is prevented. Furthermore, the shape of the pellet powder coated coke is substantially the same as that of the chemically reduced pellets, so the pellet powder coated coke is usable as a blast furnace charge as it is without any treatment of the coke. Therefore, yield of metallized pellets increases in the chemical reduction of the dried pellets.

In this connection, the reason why the range of the size of coke to be charged in the kiln is limited to from about 5 to about 30 mm is that if it is not greater than 5 mm, the pellet powder does not deposit readily on the coke and rings of pellet powder are easily formed, whereas if it is not smaller than 30 mm, the specific surface area of the cokes is less, so the amount of pellet powder deposited in proportion to the weight of the coke charged is reduced, with the result that rings of pellet powder are easily formed. With a drum index $DI_5^{30}$ lower than 70 or a tumbler index $TI_{50}^{400}$ lower than 50, the formation of the rings can not be prevented because coke is reduced to a particle size of 5 mm or less as they roll along in the kiln. If the reactivity index is higher than 50, the carbon in the coke reacts with oxygen to form CO gas, whereupon the coke is reduced to fine particles which are unsuitable for preventing the formation of rings.

The amount of coke and pellets to be charged depends upon how far the pellets have been reduced to powder in the kiln. Table 1 shows one example of operation at the start time when the proportions of the coke and pellets vary considerably.

Table 1

| | from 3 hrs before charging of dried pellets until charging thereof starts | up to 3 hrs after charging of dried pellets | from 3 to 6 hrs after charging of dried pellets | from 6 to 9 hrs after charging of dried pellets | stationary operation |
|---|---|---|---|---|---|
| amount of carbon-containing pellets* charged (t/h) | | 12 | 12 | 15 | 17 |
| amount of coke charged (t/h) | 1.5 | 1.5 | 1.0 | 0.7 | 0.4 |
| amount of coke charged / amount of carbon-containing pellets charged (t/h) | 0.125 | 0.083 | 0.047 | 0.024 | |

*Carbon-containing pellets mean pellets containing carbon required to chemically reduce metal oxides in the pellets. The carbon-containing pellets employed have the following proportion:

| Total Fe | $Fe_2O_3$ | FeO | C |
|---|---|---|---|
| 50% | 42% | 25% | 16% |

A great advantage results when coke is charged to chemically reduce the dried pellets by calcination according to the method of this invention under the above specified conditions: that is, a shut-down for removing rings formed is required only every two months, in contrast to the once a month required in the conventional art.

According to the method of this invention, formation of rings which inevitably occurs in case of chemical reduction in a rotary kiln because of the melting of the pellet powder can be effectively prevented by allowing the coke to pick up the pellet powder, thereby producing pellets of high quality in a high yield under stable operating conditions.

In this connection, it should be understood that the use of the carbon-containing pellets described in the working examples may be replaced by the use of separately charged dried pellets and carbon.

Japanese Industrial Standard K 2151 is as follows:

JAPANESE INDUSTRIAL STANDARD

Methods for Testing of Coke

2 Method for Testing particle size of coke 2.1 Summary of the test

The sample is sieved on a specific screen. The portion of sample remaining on the screen and the portion of sample passed through the screen are weighed, respectively.

2.2 Sample 2.2.1

A sample is collected according to 3 of JIS M 8811.

2.2.2 Drying of Sample

The sample collected according to 2.2.1 is air-dried to such an extent that the sample will not lose weight and can be screened without difficulty.

2.3 Screen

The screen is selected from the below-mentioned screens.

2.3.1

Mesh Size 150 mm, 125 mm 100 mm, 80 mm, 75 mm, 60 mm, 50 mm, 38 mm, 35 mm, 30 mm, 25 mm, 20 mm, 15 mm, 10 mm, 6 mm, 5 mm 2830μ, 2000μ and 1000μ

Mesh Shape

Screens having mesh size of more than 5 mm are of square mesh shape. The distance between meshes is as given in Table 1.

Table 1

| mesh size mm | Distance between meshes thickness mm | distance between meshes mm |
|---|---|---|
| more than 125 | 3.2 | 10 |
| 100 - 50 | 2.3 | 7 |
| 38 - 5 | 1.5 | 5 |

The pattern of screen having mesh size of less than 50 mm is "Gobanme" pattern and the pattern of screen having mesh size of more than 50 mm is "plover" pattern as illustrated in attached FIG. 1.

2.4 Operation 2.4.1 Manual Operation (2) The sample is weighed and is placed on a specific screen.

(3) The sieving is carried out by horizontally shaking the screen by hand.

2.4.2 Mechanical Operation

The operation is carried out in the same way as in 2.4.1

6. Method for Testing rotation strength of coke 6.1 The methods are of two types; drum test method and tumbler test method.

6.2 Drum Test Method 6.2.1 Summary

The Sample is placed in drum tester, and thereafter the drum is rotated at a specific speed for the specified number of rotations. The sample so treated is sieved by a specific screen. The weight of the portion of the sample remaining on the screen and the weight (B) of the portion of the sample passed through the screen are measured, respectively. Drum Index (D.I.) means a ratio of A to A + B.

6.2.2 Sample

A sample is collected according to 3 of JIS M 8811. The collected sample is air-dried.

6.2.3 Apparatus for Test (refer to attached FIG. 6)

(1) Drum Tester: The drum is formed of steel and has a thickness of 9 mm, an inner diameter of 1500 mm and a length of 1500 mm. Six flat bar vanes of 9 mm thick and 250 mm wide are secured to the inner surface of the drum at an equal distance in the longitudinal direction of the drum.

The side wall of the drum is provided with six holes with cover for charging the sample and withdrawing it. However, the covers should be tightly secured to the drum side wall so that the inner surface of each cover will lie in the same plane as that of the inner surface of the side wall and there is no clearance left between the cover and drum.

The drum is installed horizontally and the shaft of the drum does not extend through the drum.

The drum is provided with rotary means so that the drum may be rotated at the rate of 15 ± ½ revolutions per minute by a suitable electric motor.

(2) Screen:

The screens employed in this test are screens having mesh size of 50 mm, 25 mm and 15 mm that are employed in Item 2 of Method for Testing Particle Size of Coke 2. If necessary, screens having mesh size of 38 mm and 6 mm may be employed in this test. (refer to attached FIG. 5)

6.2.4 Operation (1) The sample is measured for its weight and slowly charged into the drum tester.

(2) The covers of the drum are tightly closed and after the drum has been rotated 30 times over 2 minutes, or 150 times over 10 minutes, the drum is immediately stopped.

(3) The sample is taken out of the drum and is sieved using a variety of screens on the order from larger mesh screen to smaller mesh screen.

(4) The portion of sample remaining on the screen and the portion of sample passed through the finest screen are weighed, respectively.

6.2.8 Expression

For each, the average of the two measurements is measured to the tenth place. The results are expressed in the following.

When using mesh screen of 38 mm or 6 mm, the results are expressed in the same way.

| Particle size (mm) | Drum Index | Symbol 30 rotations | Symbol 150 rotations |
|---|---|---|---|
| more than 50 | | $DI_{50}{}^{30}$ | $DI_{50}{}^{150}$ |
| more than 25 | | $DI_{25}{}^{30}$ | $DI_{25}{}^{150}$ |
| more than 15 | | $DI_{15}{}^{30}$ | $DI_{15}{}^{150}$ |

6.3 Tumbler Test Method 6.3.1 Summary

The sample is placed in tumbler tester, and thereafter the tumbler is rotated at a specific speed for the specified number of rotations. The sample so treated is sieved by a specific screen. The weight of the portion of the sample remaining on the screen and the weight (B) of the portion of the sample passed through the screen are measured, respectively. Tumbler Index (TI) means a ratio of A to A + B.

6.3.2 Sample

A sample is collected according to 3 of JIS M 8811. The collected sample is air-dried.

6.3.3 Apparatus for Test (refer to attached FIG. 7)

(1) Tumbler Tester: The drum is formed of steel and has a thickness of over 6 mm, an inner diameter of 914 mm and a length of 457 mm. Two angle steel vanes of 50 × 50 × 6 mm are secured to the inner surface of the drum in symmetrical relationship in the longitudinal direction of the drum. The outer surface of the drum is provided with holes and with cover for taking the sample out of and charging it into the drum. However, the covers should be so secured to the inner surface of the drum that any shoulder and/or clearance will not be formed at the interface between the drum inner surface and the cover inner surface.

The drum is installed horizontally on the shaft which has an outer diameter of 38 mm and does not extend through the drum and is provided with suitable rotary means so that the drum is rotated by a suitable electric motor 24 ± 1 rotations per minute.

(2) Screen:

The screens employed in this test are screens having 25 mm and 6 mm mesh that are employed in Item 2 of Method for Testing Particle Size of Coke. (refer to attached FIG. 5)

6.3.4 Operation (1) The sample is measured for its weight and slowly charged into the drum of tumbler tester.

(2) The covers of the drum are tighly closed and the drum is rotated 1400 revolution over about 58 minutes.

(3) The sample is taken out of the drum and is sieved using a variety of screens on the order from large mesh screen to small mesh screen.

(4) The portion of sample remaining on the screen and the portion of sample passed through the smaller screen are weighed, respectively.

6.3.8 Expression

For each, the average of the two measurements is measured to the tenth's place. The results are expressed in the following.

| Particle size of coke (mm) | Tumbler Index | Symbol |
|---|---|---|
| more than 25 | | $TI_{25}$ |
| more than 6 | | $TI_6$ |

7. Method for Testing reactivity of coke 7.1 Summary

The sample is charged into a reactor having a specific temperature to a specific height therein. Carbon dioxide is passed through the sample layer at a specific flow speed. The flow speed of carbon monooxide formed is measured. The amount of carbon monoxide formed means the reactivity of coke.

7.2 Sample

The sample is collected according to 3 of JIS M 8811. The dried sample is ground and reduced to obtain sample batches of about 100 g each within the grain size range of 840 micron lent to 20 mesh) to 1680 micron (equivalent to 10 mesh).

7.3 Apparatus for Test (refer to attached FIG. 8)

(1) Carbon dioxide Pressure Regulator: The regulator is a glass container having a diameter of about 40 mm and a height of about 700 mm; it is filled with water up to 200 mm from the lower end of the gas introduction within the container.

(2) Carbon Dioxide Drying Bottle: The bottle is a 300 ml glass container into which concentrated sulfuric acid is placed.

(3) Carbon Dioxide Flow Regulator: A rubber tube is pinched by a screw cock to regulate the flow rate of carbon dioxide.

(4) Carbon Dioxide Capillary Flowmeter: The flowmeter comprises a capillary tube and a differential pressure gauge. The capillary tube employed has a diameter suitable for measuring the flow rate of 50 ml per minute. And in order to maintain the temperature of gas placed in the flowmeter constant, the flowmeter has a gas introduction tube attached thereto in front of the inlet. The flowmeter initially measures the relationship between the flow rate and differential pressure of carbon dioxide at 25° C. to seek the differential pressure at the flow rate of 50 ml per minute.

(5) Carbon Dioxide Pressure Guage: The guage is a U-shaped glass tube having a diameter of about 7 mm and a height of about 500 mm and contains oil therein.

(6) Electric Furnace and Reaction Tube: The electric furnace has an outer diameter of about 150 mm and a length of about 400 mm and is supported on electric steel legs for rotation about the center axis. The electric furnace is capable of maintaining the temperature of the sample layer at 950° C. ± 2° C. The reaction tube is formed of opaque quartz and has an inner diameter of 20 mm and a length of about 600 mm. The reaction tube is firmly secured to the electric furnace and a rubber plug having a carbon dioxide introduction tube attached thereto is put in the lower end of the tube. The rubber plug has a porcelain plate on which the sample is placed and a quartz holding tube for holding the porcelain tube. The upper end of the reaction tube is provided with a gas introduction tube through which a thermocouple protection tube of the outer diameter of 5 mm extends attached thereto by the rubber plug. The leading end of the thermocouple prrotection tube extends through the center hole in the porcelain plate and the leading end of the thermocouple is positioned in the center of the sample layer (50 mm).

(7) Pyrometer and Thermocouple: The pyrometer is a PR 1600° C.-0.5 class indicator.

(8) Carbon Dioxide Absorber Tube: The tube is a cylindrical glass container and has a diameter of about 40 mm and a height of about 500 mm. The container is filled with a filler of 3-4 mm (glass ball, coke or the like). The upper portion of the glass container has a funnel (capacity of about 50 ml) with a rubber plug inserted therein through which absorptive solution (about 30% caustic potash) is poured and the lower portion of the container has a extractor cock.

(9) Carbon Monoxide Drier: The drier is a U-shaped tube having a diameter of about 20 mm and a height of about 100 mm and is filled with calcium chloride for drying.

(10) Carbon Monoxide Capillary Tube Flowmeter: The flowmeter is the same type as the carbon dioxide capillary tube flowmeter in (4). Two capillary tubes for carbon monoxide having the capacity of 0 - ml and 40-100 ml per minute, respectively are employed. As in the case of (4), the flowmeter intitially measures the relationship between the flow rate and differential pressure and the measured result is graphed.

(11) Carbon Monoxide Pressure Guage

(12) Carbon Monoxide Flow Rate Adjuster

(13) Carbon Monoxide Pressure Adjuster

These devices are the same type as those for carbon dioxide in (5), (3) and (1), respectively. Except for the devices in (6) and (7), the devices referred to hereinabove are mounted on wooden support means. These devices are connected to each other by means of glass and rubber tubes in air-tight relationship. The inlet of each of these devices is connected to a carbon dioxide bomb (purity over 99.0%) through a reduction valve and finally connected to an aspirator. The capillary tube flowmeters as mentioned in (4) and (10) are held in the same water tank and the temperature of the water tank is maintained at about 25° C. by pouring warm water or cold water into the water tank.

7.4 Operation:

(1) The temperature of the water tank is maintained at 25° C. and that of the electric furnace is maintained at about 950° C.

(2) The rubber plug is lifted up to the degree that the thermocouple protection tube will not be pulled off the porcelain plate with the connection tube detached from the outlet of the reaction tube, and the sample is placed onto the porcelain plate.

(3) Carbon dioxide is passed through the reaction tube at the rate of about 50 ml per minute and discharged out of the reaction tube together with the residue volatile matter and moisture in the sample for about 20 minutes. During the operation, the voltage is adjusted to raise the temperature, which has dropped due to the introduction of the sample to 950° C.

(4) The supernatant solution in the amount of 20-30 ml is poured into the carbon dioxide absorption tube and the outlet of the reaction tube is connected to the absorption tube while maintaining the furnace temperature at 950° C. ± 2° C.

(5) The end of the device is connected to the aspirator to be sucked thereby, and carbon dioxide is passed through the reaction tube while adjusting the flow rate by the adjusters in (3) and (12) so that the pressure guage in (5) indicates +10 mm and the flowmeter in (4) precisely shows the flow rate of 50 ml per minute.

(6) Since the flow rate of carbon dioxide varies according as the differential pressure on the carbon monooxide flowmeter in (10) drops gradually, the difference pressure on carbon monoxide flowmeter is recorded at the interval of two minutes while adjusting the flow rate continuously be the adjuster in (12).

In such a case, the pressure on the pressure guage in (11) shows the degree of reduction in pressure for the suction of carbon monooxide.

(7) After the differential pressure on the carbon monoxide flow meter has become substantially constant, the recording is continued for 20 minutes and the flow rate per minute is obtained against the graph by the differential pressure at the termination of the 20 minute recording against the graph.

7.8 Expression

The average of the two measurements is measured to the tenth place. The value means the reactivity index.

Note: 2

The gas thus formed may be analysed by using gas-chromatograph equipment, infrared gas analyser and the like in place of Carbon Monoxide Flow Rate adjuster. In this case, the components contained in said gas are analysed. The CO content in the gas represents the reactivity index. When using gas-chromatograph equipment and inferred gas analyser, etc., the value is specially described as "reactivity index (AG)."

What is claimed is:

1. A process for indurating dried pellets in a rotary kiln, characterized by charging the dried pellets and coke in the range of from about 2% by weight to about 20% by weight on the weight of the pellets into the rotary kiln and heating the pellets in the kiln, the coke having a size of from about 5 millimeters to about 30 millimeters, a drum index ($DI_5^{80}$) of more than 70, a reactivity index (AG) of less than 50 and a tumbler index ($TI_{50}^{400}$) of more than 50.

2. The process of claim 1, wherein the dried pellets of high metallic iron content.

3. A process for indurating dried pellets in a rotary kiln having a low temperature zone and a high temperature zone, which comprises:

charging the dried pellets and coke to the low temperature zone of the rotary kiln, the amount of coke being from about 2 to about 20 percent by weight of the weight of the dried pellets, the coke having the properties:

(i) particle size of from about 5 to about 30 millimeters, (ii) drum index ($DI_5^{80}$) of more than 70, (iii) reactivity index (AG) of less than 50, and (iv) tumbler index ($TI_{50}^{400}$) of more than 50, passing the resulting mixture of dried pellets and coke through the rotary kiln from the low temperature zone to the high temperature zone thereof, whereby the surface of said coke is coated with powder of the dried pellets formed as the kiln rotates and the resulting powder-coated coke is not burned in the kiln, and removing said resulting powder-coated coke from the rotary kiln.

* * * * *

UNITED STATES PATENT AND TRADEMARK OFFICE

CERTIFICATE OF CORRECTION

PATENT NO. : 4,145,210

DATED : March 20, 1979

INVENTOR(S) : KAZUMASA KATO et al

It is certified that error appears in the above-identified patent and that said Letters Patent are hereby corrected as shown below:

1) Column 2, line 41: replace "(DIhd $5^{80}$)" with ---($DI_5^{80}$)---.

2) Columns 3-4, Table 1:

under the heading "from 3 hours before charging", delete "0.125";

under the heading "up to 3 hrs after charging", replace "0.083" with ---0.125---;

under the heading "from 3 to 6 hours after charging", replace "0.047" with ---0.083---;

under the heading "from 6 to 9 hours after charging", replace "0.024" with ---0.047---; and under the heading "stationary operation", insert ---0.024---.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*